US007585556B2

(12) United States Patent
Julton

(10) Patent No.: US 7,585,556 B2
(45) Date of Patent: Sep. 8, 2009

(54) STUDDED PLATE WITH FOLD LINE

(75) Inventor: Svein Julton, Kongsberg (NO)

(73) Assignee: Isola AS, Notodden (NO)

( * ) Notice: Subject to any disclaimer, the term of this patent is extended or adjusted under 35 U.S.C. 154(b) by 284 days.

(21) Appl. No.: 11/106,241

(22) Filed: Apr. 14, 2005

(65) Prior Publication Data

US 2005/0229520 A1 Oct. 20, 2005

(30) Foreign Application Priority Data

Apr. 15, 2004 (NO) ..... 20041545

(51) Int. Cl.
*B32B 3/00* (2006.01)
*E02D 19/00* (2006.01)
*E02B 11/00* (2006.01)

(52) U.S. Cl. ..... 428/156; 428/172; 428/212; 405/36; 405/50; 52/169.14; 52/302.1; 52/311.1; 52/408

(58) Field of Classification Search ..... 52/302.1, 52/311.1, 408, 413, 169.14; 428/156, 172, 428/212; 405/36, 43, 50
See application file for complete search history.

(56) References Cited

U.S. PATENT DOCUMENTS

| | | | |
|---|---|---|---|
| 1,277,622 | A | 9/1918 | Madison |
| 1,302,822 | A | 5/1919 | Madison |
| 1,430,080 | A | 9/1922 | Hicks |
| 1,485,370 | A | 3/1924 | Cumfer |
| 1,503,783 | A | 8/1924 | Dahlberg |
| 1,919,354 | A | 7/1933 | Anderson |
| 1,965,282 | A | 7/1934 | Ellithorpe et al. |
| 2,030,556 | A | 2/1936 | Veltung |
| 2,031,680 | A | 2/1936 | Tuthill |
| 2,245,690 | A | 6/1941 | Krueger |
| 2,678,896 | A | 5/1954 | Dratler |

(Continued)

FOREIGN PATENT DOCUMENTS

| | | |
|---|---|---|
| DE | 1 929 878 | 12/1970 |

(Continued)

OTHER PUBLICATIONS

Norwegian Search Report 20041545.

(Continued)

*Primary Examiner*—Donald Loney
(74) *Attorney, Agent, or Firm*—Myers Bigel Sibley & Sajovec, PA

(57) ABSTRACT

The present invention concerns a studded plate (1), comprising a first longitudinal edge (60) and a second longitudinal edge (61) between which edges are arranged a main area (90) in the longitudinal direction of the plate (1) comprising a first type of studs (12), characterized in that the main area (90) comprises at least one sub area (100), in the longitudinal direction of the plate (1), comprising at least one first row of a second type of studs (14, 114, 214) which have an oblong shape in the longitudinal direction of the plate (1) and at least one adjacent longitudinal row of a similar stud (14) and/or a third type of studs (13, 113, 213) comprising a longitudinal adjacent border to the first row of studs (12), wherein studs (14) in the first row are offset in the longitudinal direction in relation to the studs in the adjacent row(s).

14 Claims, 8 Drawing Sheets

U.S. PATENT DOCUMENTS

| | | | | |
|---|---|---|---|---|
| 3,025,722 | A | | 3/1962 | Eger, Jr. et al. |
| 3,086,899 | A | | 4/1963 | Smith et al. |
| 3,238,682 | A | | 3/1966 | Tracy et al. |
| 3,419,457 | A | | 12/1968 | Bleasdale |
| 3,533,896 | A | | 10/1970 | Hartig |
| 3,812,636 | A | | 5/1974 | Albrecht et al. |
| 3,888,087 | A | * | 6/1975 | Bergsland ..... 405/36 |
| 4,318,258 | A | | 3/1982 | Heck |
| 4,601,147 | A | | 7/1986 | Migliore |
| 4,637,184 | A | | 1/1987 | Radtke et al. |
| 4,671,983 | A | * | 6/1987 | Burt ..... 428/179 |
| 4,917,933 | A | | 4/1990 | Schluter |
| 4,932,182 | A | | 6/1990 | Thomasson |
| 5,016,413 | A | | 5/1991 | Counihan |
| 5,042,569 | A | | 8/1991 | Siegmund |
| 5,052,161 | A | | 10/1991 | Whitacre |
| 5,255,482 | A | | 10/1993 | Whitacre |
| 5,287,671 | A | | 2/1994 | Ueki |
| 5,323,575 | A | | 6/1994 | Yeh |
| 5,383,314 | A | | 1/1995 | Rothberg |
| 5,418,036 | A | | 5/1995 | Tokikawa et al. |
| 5,489,462 | A | | 2/1996 | Sieber |
| 5,566,522 | A | | 10/1996 | Alander |
| 5,572,842 | A | | 11/1996 | Stief |
| 5,619,832 | A | | 4/1997 | Myrvold |
| 5,775,039 | A | | 7/1998 | McPherson |
| 5,822,937 | A | | 10/1998 | Mahony |
| 6,000,184 | A | | 12/1999 | Fernandes |
| 6,151,854 | A | | 11/2000 | Gutjahr |
| 6,434,901 | B1 | | 8/2002 | Schluter |

FOREIGN PATENT DOCUMENTS

| | | | |
|---|---|---|---|
| DE | 26 50 160 | A1 | 5/1978 |
| DE | 29 47 499 | B1 | 6/1981 |
| DE | 30 45 390 | A1 | 6/1982 |
| DE | 31 03 632 | A1 | 8/1982 |
| DE | 83 11 020 | U1 | 4/1983 |
| DE | 84 12 830.5 | U1 | 10/1984 |
| DE | 299 24 180 | U1 | 10/1984 |
| DE | 35 12 527 | C1 | 7/1986 |
| DE | 36 41 971 | A1 | 6/1988 |
| DE | 37 01 414 | A1 | 7/1988 |
| DE | 91 14 591 | U1 | 3/1993 |
| DE | 44 35 895 | A1 | 4/1996 |
| DE | 296 02 442 | U1 | 4/1996 |
| DE | 296 22 129 | U1 | 4/1997 |
| DE | 298 07 258 | U1 | 7/1998 |
| DE | 298 06 561 | U1 | 11/1998 |
| DE | 197 50 277 | A1 | 5/1999 |
| DE | 299 15 866 | U1 | 5/2000 |
| DE | 299 21 970 | U1 | 4/2001 |
| DE | 33 13 476 | A1 | 5/2002 |
| DE | 299 24 526 | U1 | 9/2003 |
| EP | 0 275 454 | B1 | 7/1988 |
| EP | 0 636 199 | B1 | 2/1995 |
| EP | 0 801 186 | A1 | 10/1997 |
| EP | 1 068 413 | B1 | 11/1999 |
| EP | 1 068 413 | B1 | 1/2001 |
| EP | 1 073 813 | B1 | 2/2001 |
| FR | 1 444 070 | | 7/1966 |
| FR | 2 544 460 | A1 | 10/1984 |
| GB | 2 141 459 | A | 12/1984 |
| NO | 313 942 | B1 | 10/1999 |
| NO | 77826 | | 4/2004 |
| WO | WO 82/03099 | | 9/1982 |
| WO | WO 97/04178 | A1 | 2/1997 |
| WO | WO 99/25940 | | 3/1999 |
| WO | WO 99/54571 | | 10/1999 |
| WO | WO 99/55985 | | 11/1999 |
| WO | WO 00/42258 | | 7/2000 |

OTHER PUBLICATIONS

Data Sheet "Datablad Paton Grunnmurplate D16.4", AS Platon, 2 pages, Sep. 1978.

Data Sheet "Datablad Paton Grunnmurplate D12.1", AS Platon, 2 pages, Jan. 1977.

European Search Report, European Application No. EP 05008263, dated Aug. 8, 2005 (2 pages).

* cited by examiner

STUDDED PLATE WITH FOLD LINE

RELATED APPLICATION

This application claims the benefit of priority from Norwegian Patent Application No. NO 20041545, filed on Apr. 15, 2004, in the Norwegian Patent Office, the disclosure of which is hereby incorporated herein by reference in its entirety.

AREA OF THE INVENTION

The present invention concerns a studded plate, such as a plate of a film like material, for use as a support against floors, walls, ceilings and roofs, and especially as a support for flooring on concrete floors with tiles, floor covering or wooden floors. The invention also concerns the use of the studded plate and a method of placement of the plate.

TECHNICAL BACKGROUND

Many different types of studded plates which may be used as supporting plates are known. They may be used as ordinary supporting plates, drainage plates, decoupling plates, or plaster plates for plastering or support for adhesive for tiles for example when flooring with ceramic tiles.

All concrete floors resting on the ground contain moisture. Floor coverings such as wooden floors can therefore not be placed directly on the concrete. Many years may be needed to dry out a concrete floor placed on the ground. The floor may also be affected by rising damp. Initially, all concrete floors contain residual moisture and the above problem therefore concerns cellars, basement floors, slab on ground floors and floor between different storeys of different types of concrete, including for example floors made of light expanded clay aggregate concrete and lightweight concrete. The moisture in the concrete is often invisible and difficult to detect. This results in an unawareness of the risks such as rot, moisture damage etc. Without an effective damp proof membrane with sufficient performance characteristics, moisture from the concrete will for example attack wood materials from underneath. The same problem also concerns tiled floors wherein the filled joints will allow passage of moisture.

The result is damaged floors with cracks, mould and rot. In addition, hazardous mould spores, bad smell and a poor indoor environment may result.

The same effect may arise on concrete walls, as in floors, and contain or be affected by rising damp, especially basements with below ground walls.

To solve this problem, studded plates are used for most problems related to moisture in cellars providing "passive" venting towards the room. The studded plates often comprise hollow studs with circular or rounded cross-section, i.e. the form of the circumference of the studs, with a height from 3 to 5 mm. The studs are often distributed in a diamond pattern or a check-board pattern providing adequate distribution of the loading as well as venting. The studded plates are places with the top of the studs facing downwards toward the base floor to obtain an air gap on the underside of the plate, between the studs.

The plates may be joined by sealing tape on the topside of the plates to obtain a sealed floor. In case of severe problems with moisture, smell or other emissions, the air gap beneath the studded plates may be ventilated mechanically in order to provide air flow over the concrete plate and create a negative pressure in relation to the room. A ventilated air gap may also contribute in the drying out of the concrete.

Recently, plates have been developed comprising studs with undercuts or overhangs, meaning that the area of the opening of a stud is smaller than the area of the top of the stud, giving a good anchoring of plaster or adhesive, independent of which face the plaster or adhesive is applied. Such a plate is described in EP 1 068 413 issued on Aug. 10, 2004 to Isola AS for example.

The studs in the above mentioned patent are characterized by a uniform shape of the studs which are distributed on the plate in a repeated pattern. The pattern often allows folding of the plate in the longitudinal and/or transverse direction of the plate, but also in a 45° angle.

However, it is a problem with the above mentioned solution that a plate placed on the floor should be turned up against the wall of the room, in order to guide the humid air out of the air gap. In other words, the air gap must be in contact with the room. In the simplest manner, this is achieved by folding the plate at the transition between the floor and the wall. The problem with this solution is that all the above mentioned plates thereby obtain a folding crease which either inhibits the transport of humid air or for example the plate comes in direct contact with the adhesive used against the floor thereby blocking the air gap.

It is also quite usual to laminate the studded plate with a fabric or a grid on the top of the studs in order to bond the plate temporarily or permanently to the concrete floor, so that the plate is evenly fixed to the substrate during installation of the floor covering or tiles. The fabric, which will be applied with adhesive, will also contribute in blocking the transport of air as it will be stretched against the folding crease of the plate and thereby block the air gap.

One solution to this problem has been to place the plate on the floor at a small distance from the wall and to use a special edge plate which is bonded onto the top face at the edge of the plate on the floor, to finish the venting towards the room. However, there is always a risk that plates on the floor are pushed towards the wall and will remain in contact with the wall, or that adhesive is pressed into the junction between the floor and the wall, thereby blocking the venting.

The present invention is aimed at solving the above problems and to provide a plate and a method for placing it so that transport of moisture is secured away from the substrate, such as a floor, in a simple and sure manner.

BRIEF DESCRIPTION OF THE INVENTION

The present invention concerns a studded plate wherein at least one edge in the longitudinal direction of the plate has a fold line which maintains airflow even when the plate is folded at 90° along the edge. The described studded plate thereby secures venting and equalization of the water vapour pressure across the floor, as well as reducing the risk of capillary action.

The present invention therefore concerns a studded plate, comprising a first longitudinal edge and a second longitudinal edge between which are arranged a main area in the longitudinal direction of the plate comprising a first type of studs, wherein the main area comprises at least one sub area, in the longitudinal direction of the plate, with a second type of stud which have an elongated or oblong shape in the longitudinal direction of the plate and at least one adjacent longitudinal row of a similar stud and/or a third type of stud comprising a longitudinal adjacent border to the first row of studs, wherein studs in the first row are offset in the longitudinal direction in relation to the studs in the adjacent row(s).

The main advantage with this system is that a whole room may be covered with one type of plate without the need for other specialty plates and parts other than a jointing tape.

DESCRIPTION OF THE DRAWINGS

In order to explain the invention in more detail, basis is made in four embodiments of the invention and the attached drawings wherein.

DETAILED DESCRIPTION

Figure 1:
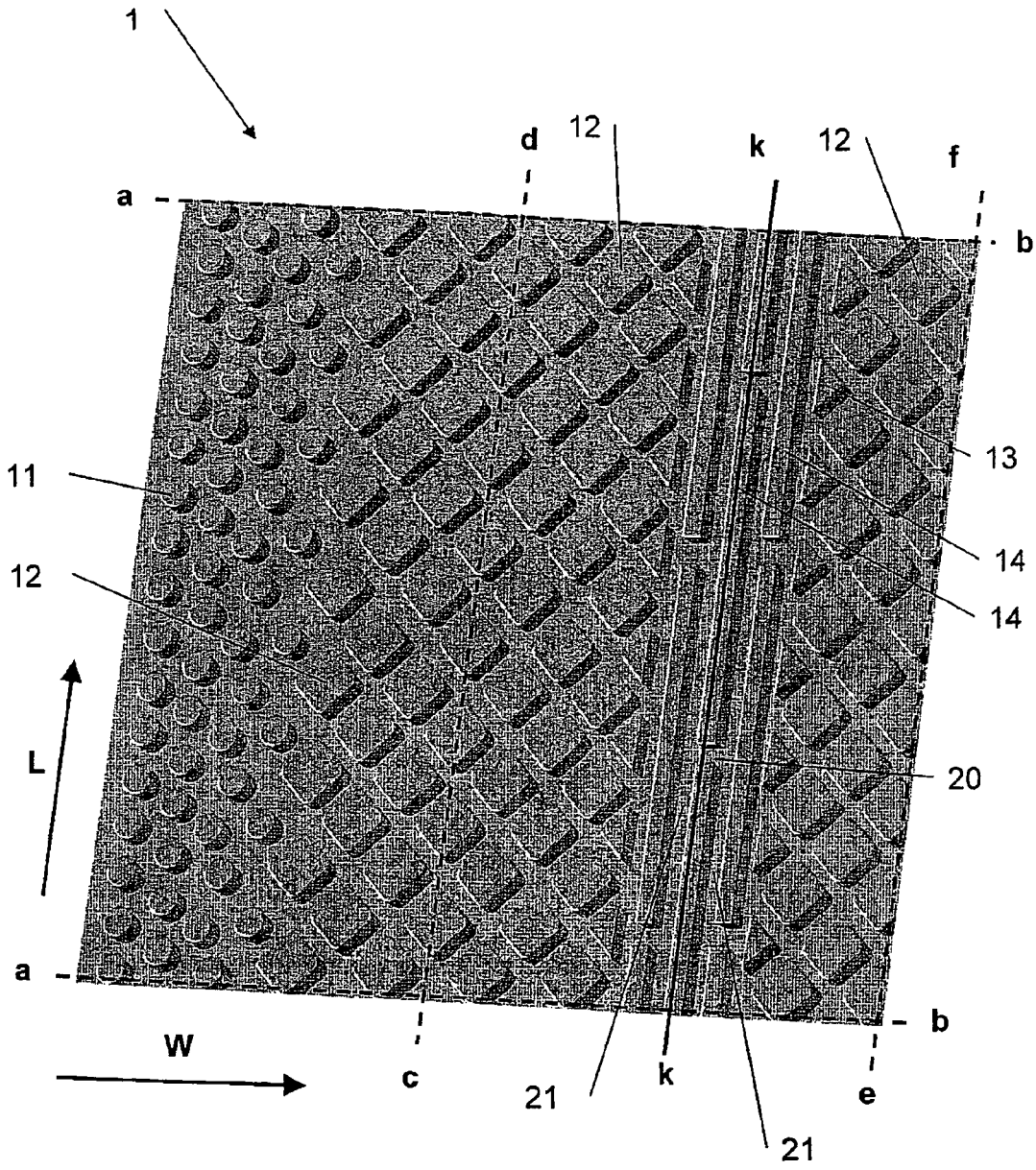
FIG. 1 shows a perspective view of a studded plate according to a first embodiment of the invention viewed from underneath.

The invention will be further described in greater detail by examples of embodiments which are not meant to limit the scope of the invention, which is defined by the attached set of claims only.

The present invention is mainly directed at studded plates having studs protruding only on one surface side of the plate. However, plates containing studs protruding on both surface sides of the plate are also contemplated.

In the further description the following terms will be used:

"Longitudinal" is assigned to the direction of a sheet of the plate with the largest dimension which may be the production direction and the direction in which the sheet may be rolled up.

"Transverse" is assigned to the direction of a sheet of the plate perpendicular to the longitudinal or production direction.

"Longitudinal edge" is assigned to edges of the plate parallel to the longitudinal direction.

"Studs" is assigned to the protrusions extending out of the surface of the plate.

"Bottom face" and "underneath" is meant to refer to the face of the plate where the studs protrude out of the surface of plate, the area being uneven according to the shape, number and height of studs in the plate.

"Top face" is meant to refer to the face of the plate normally visible after placing it on a substrate, the area being relatively smooth with hollows leading into the plate.

"Channels" are referred to the spaces formed between the studs protruding out on the bottom face of the plate.

"Undercut" or "overhang" refers to studs having non-perpendicular walls in relation to the surface of the plate. In the following embodiments some of the studs have a smaller opening on the top face of the plate, than the top of the stud, giving the stud an undercut or overhang. In the drawings viewed from underneath, this effect may be seen from the dotted lines of the studs representing the opening hole of the stud on the opposite top face of the plate, which may be smaller than the solid lines of the stud, representing the outer circumference of the top of the stud resting against the substrate. The position of the opening of the stud may in addition be different from the position of the top of the stud, giving a larger or lesser degree of overhang in different parts of the stud.

A first embodiment of the invention is shown in FIG. 1, which is a part of a studded plate according to the invention. The plate has a longitudinal direction L and normally such sheets are rolled up in lengths of 20 meters. The plate has a transverse direction W, and the width of a sheet is normally about 1 or 2 meters. The height of the studs in this example is constant at about 3 millimeters, but may be smaller or larger or possibly of varying height.

In the longitudinal direction, the plate is divided in areas of different widths, comprising different types of studs 11, 12, 13 and 14 of different shapes and sizes when following the line a-b. The width of the different areas may vary and the line c-d designates an unidentified width. The line e-f marks an incomplete longitudinal edge as the plate may have different widths, either with the same type of studs, or other studs as shown on other parts of the plate in FIG. 1.

As may be seen from FIG. 1, an edge area of round small studs 11 is present along one longitudinal edge. These studs 11 have a constant circumference in the whole depth of the stud and the diameter in this example is about 8 millimeters. The width of the area may for example be from about 3 to about 5 centimeters.

In the present invention, an improvement of the plate in EP 1 068 413 is used, wherein the longitudinal edges of the sheet includes another type of studs, as given in the Norwegian registered design 77826 and the corresponding US Design No. 29/178,693. The studs 11 in the longitudinal edges have the object of securing that a continuous air gap is maintained in the joining of plates, and of providing extra load bearing strength at the edges and joints of the plates. The circular studs 11 are smaller and differently shaped than the main studs 12, which in this embodiment are square, and are distributed in a pattern providing more channels than the main studs 12. In the jointing with main studs 12, the small studs 11 will secure that the air gap is continuous across the joint and provide relative good transport for moisture being directed across.

The area of small studs 11 borders an area with the mentioned main studs 12. In this example, the studs have a rounded square form and lie in a diagonal pattern in the longitudinal direction L. The main studs 12 contain undercuts by being truncated at the opening in relation to the top of the stud. These overhangs or undercuts may be used to anchor different types of materials such as plaster or adhesives for tiles on either face of the plate. The studs in this example are of a mean width and length of about 1.7 centimeters and the area containing these studs, is from about 8 to 10 centimeters wide. Part studs 13 with a triangular form are placed along the edge of this area of main studs 12.

The next area has oblong studs 14, placed in rows oriented in the longitudinal direction L of the plate 1. These studs define a fold line of which the centre is indicated by the line k-k in FIG. 1. The sub area with oblong studs 14 is in this example about 2.5 centimeters wide.

On the other side of the sub area with studs 14, half studs 13 border another area of main studs 12 which continue past the line e-f. The width of this area with studs 12 is dependent on the width of the plate 1 and constitutes the main part of the plate placed against the floor. This area may be completed with the same type of main studs 12, or preferably an edge area with small round studs 11 for simplifying possible joints against plates that are cut, or to increase the strength.

As may be seen from FIG. 1, the rows of the oblong studs 14 provide longitudinal channels 21 with transverse openings 20 in-between, the openings 20 being offset in relation to each other in the longitudinal direction. The channels 21 are especially designed for the folding of the plate, for example at the transition from a floor to a wall. The oblong studs 14 do not contain undercuts in this embodiment.

Figure 2:
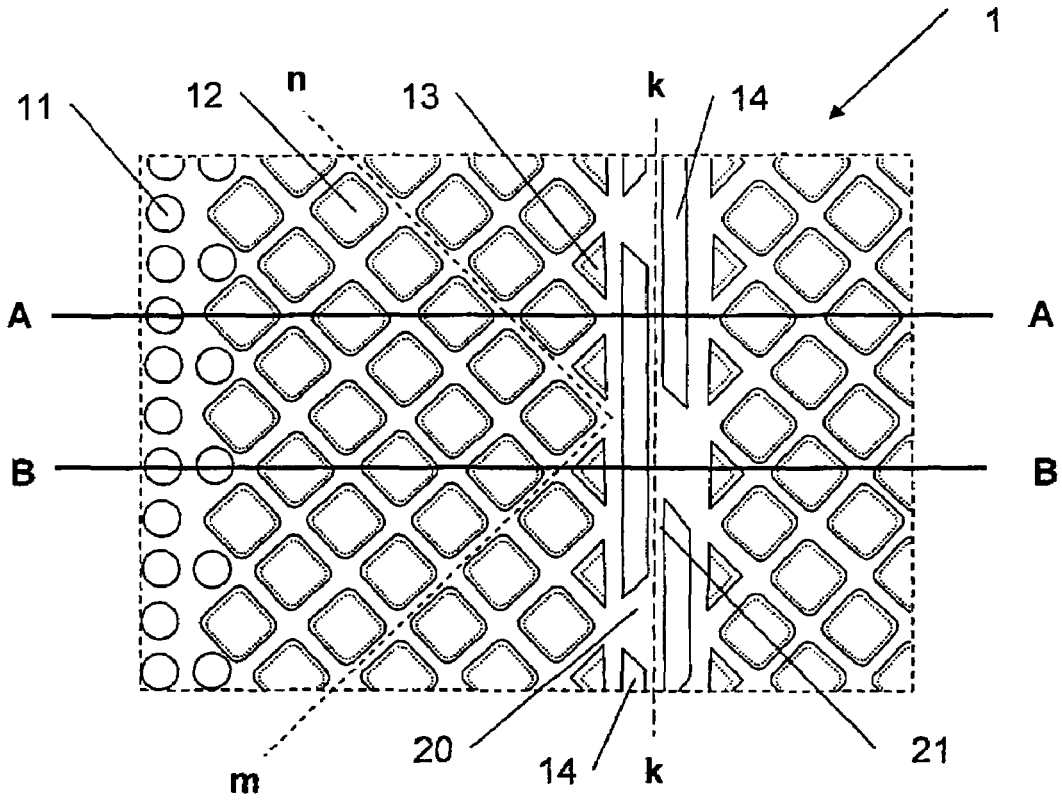
FIG. 2 shows a planar view of a studded plate according to a second embodiment viewed from underneath.
Figure 3:
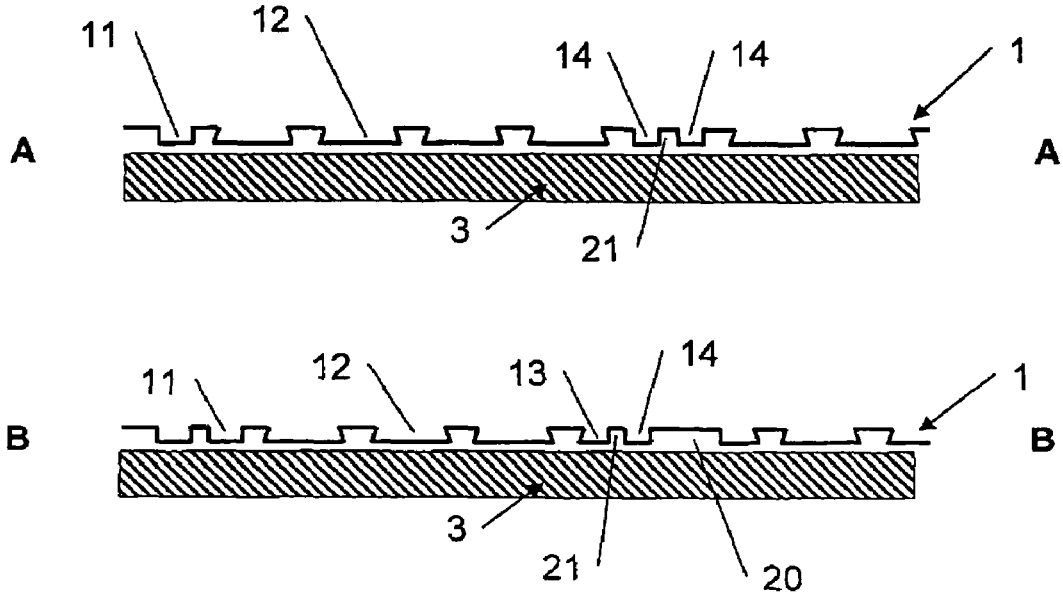
FIG. 3 shows two cross sections of the studded plate in FIG. 2 along the lines A-A and B-B respectively placed against a floor support.

In order to better understand the shape of the studs, a similar second embodiment of a studded plate 1 is shown in FIG. 2, viewed from the bottom side with two marked sectional lines A-A and B-B. In FIG. 3 the profiles of cross sections A-A and B-B are represented with the plate placed against a substrate 3.

Figure 4:
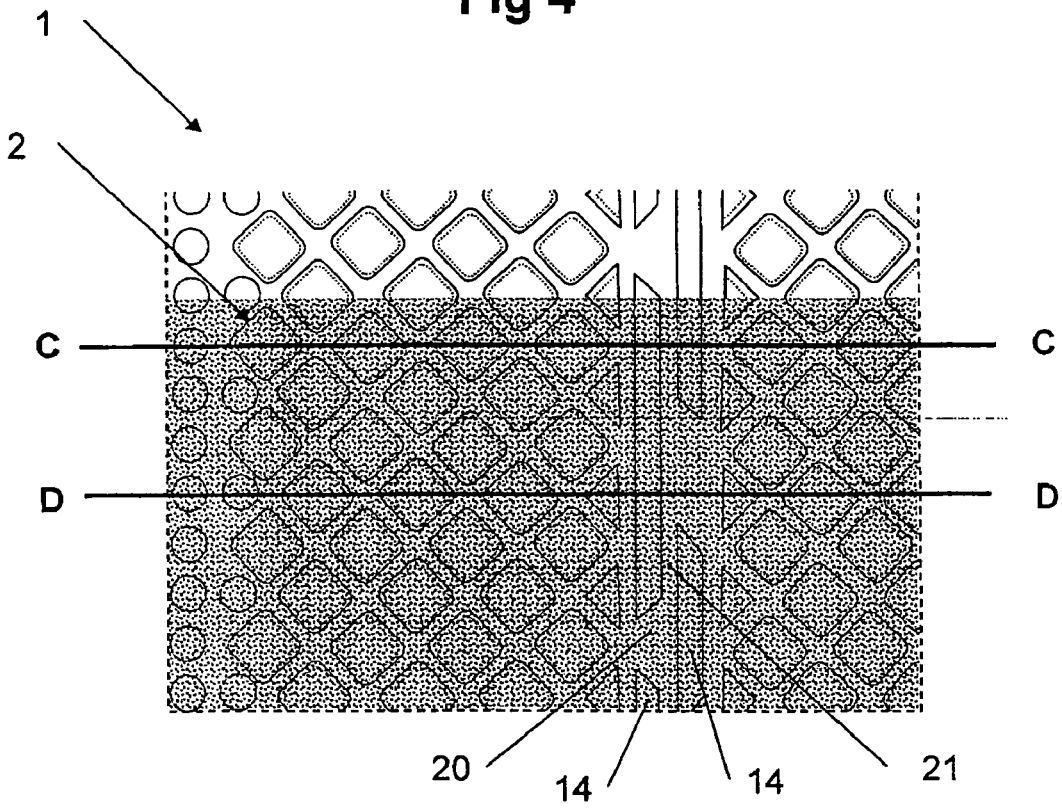
FIG. 4 shows the studded plate in FIG. 2 with an applied fabric.
Figure 5:
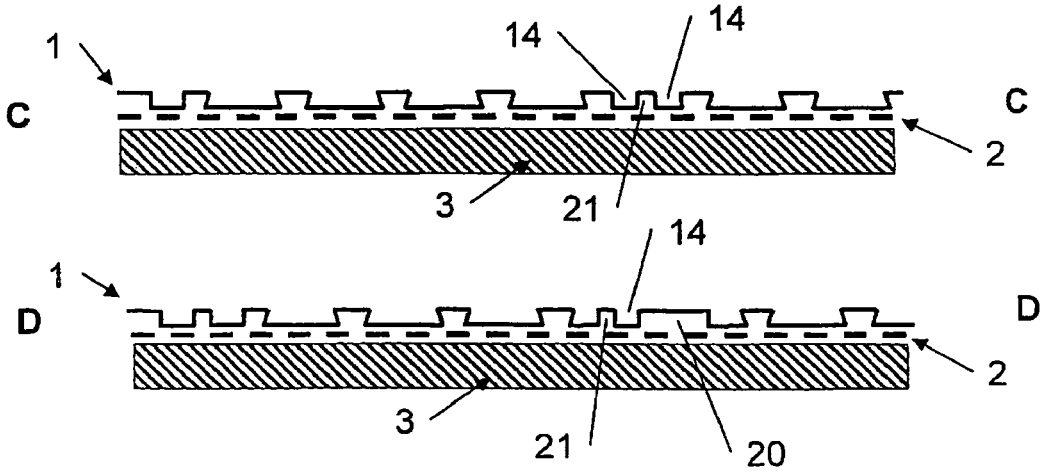
FIG. 5 shows two cross sections of the studded plate in FIG. 4 along the lines C-C and D-D respectively placed against a floor support.

In order to fasten the studded plate to the substrate, it is an advantage, as mentioned initially, to use a fabric or a grid 2 as shown in FIG. 4 which may be applied to the studded plate in advance. The top of the studs 11, 12, 13 and 14 in FIG. 1 are for example provided with a fabric 2 in FIG. 4 of a suitable material by adhesive or lamination. This fabric 2 may then be used for fixing the plate to the substrate, such as a concrete floor or a wall, either permanently or temporarily. In FIG. 5 the profiles of the cross sections C-C and D-D are respectively reproduced when the plate 1 with fabric 2 is placed against a floor 3. As may be seen from the FIG. 5, the offset positioning in the longitudinal direction of the transverse openings 20, always provide at least one oblong stud 14 in the fold line placed against the substrate, in this case the floor.

Figure 6:
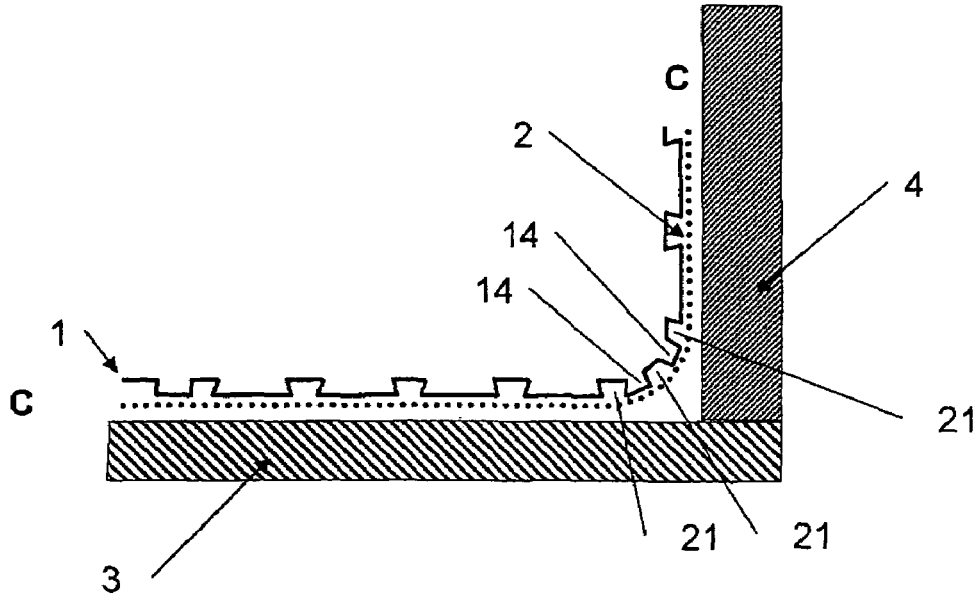
FIG. 6 shows two cross sections of the studded plate in FIG. 4 along the lines C-C and D-D respectively placed in a folded up state against a supporting floor and wall.
Figure 6:
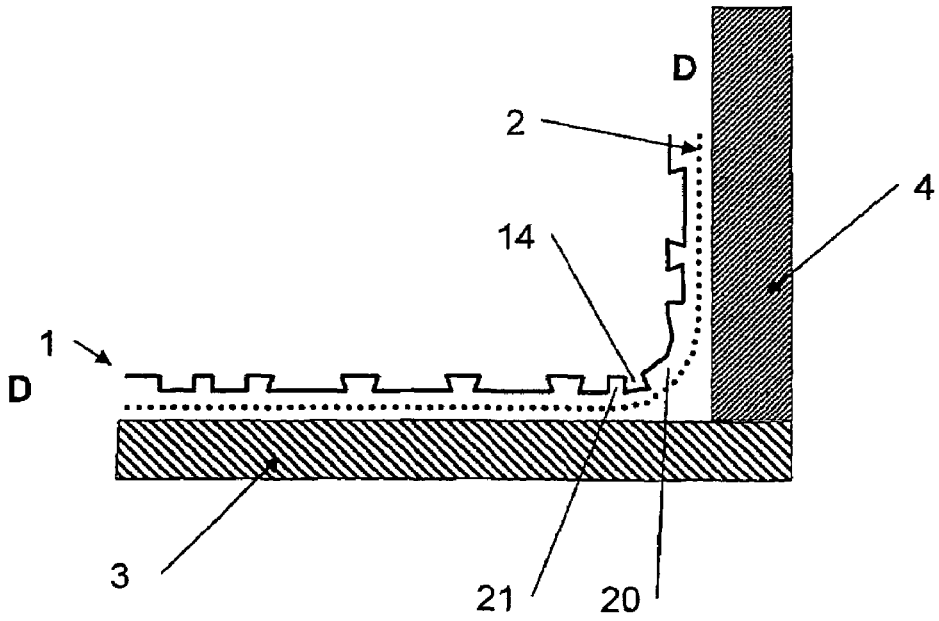

The latter is important in the folding of the plate 1 with fabric 2, as shown in FIG. 6 wherein the cross sectional profiles in FIG. 5 are represented in a folded up state. The plate 1 is placed against a floor 3 and the longitudinal edge of the plate is folded up against a wall 4, and the fabric 2 may be glued to both the floor 3 and the wall 4. From the profile of C-C it may be seen that the fabric 2 is stretched out by the studs 14 and are prevented from contacting the surface of the plate 1 between studs. In this manner the transverse openings 20 are maintained open as shown by profile D-D in the same figure. It is important that neither the width nor the length of the transverse opening 20 is too large so that the fabric 2 may contact the surface of the plate 1 between studs. In this example the width of the opening is about 5 millimeters, and approximately the same width as the oblong stud 14. However the person skilled in the art will be able to determine the suitable width without undue experimentation based on the disclosure of the present invention. It is also important that there are not too many openings 20 and that they are not in the same position in adjacent rows so that there always is one oblong stud 14 stretching the fabric 2 as shown by the profile D-D. A too long unsupported distance for the fabric will result in the fabric contacting the plate. In this embodiment of the plate, as shown in FIG. 4-6, the fabric will be stretched out by two rows of oblong studs 14, and thereby secure continuation of the air gap. As mentioned above the person skilled in the art will also be able to determine this feature without undue experimentation based on the present disclosure.

Figure 7:
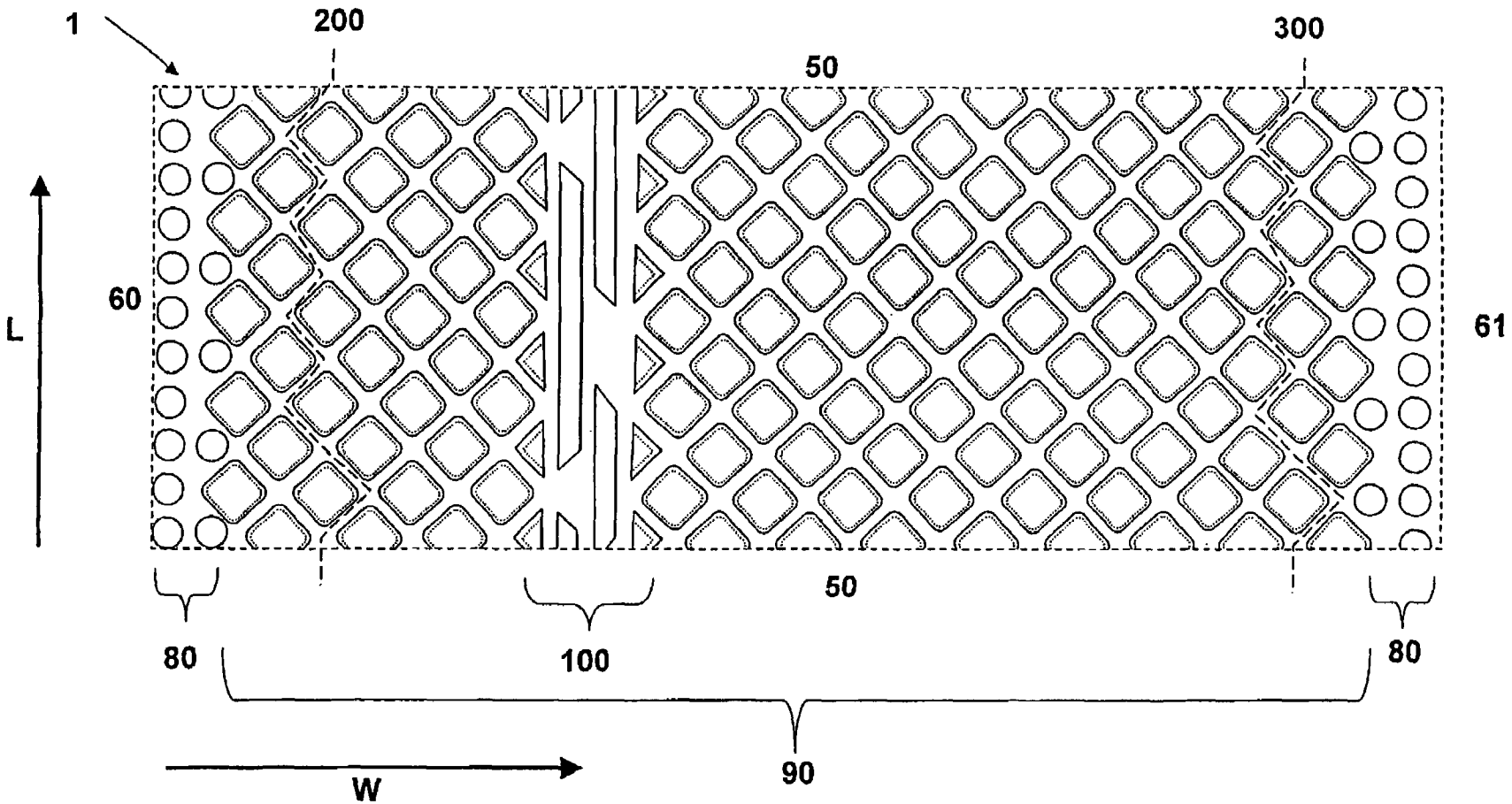
FIG. 7 shows an extended planar view of the studded plate in FIG. 2.

FIG. 7 shows a typical width of a plate 1 cut in the transverse direction with edges 50, with longitudinal edges 60 and 61, wherein the main area 90 with square studs 12 is divided by a sub area 100 with oblong studs 14 making up the fold line, and wherein both longitudinal edges of the plate 1 have areas 80 with small round studs 11. The lines 200 and 300 indicate that the width of the main area 90 is not restricted on either side of the sub area 100.

Figure 8:
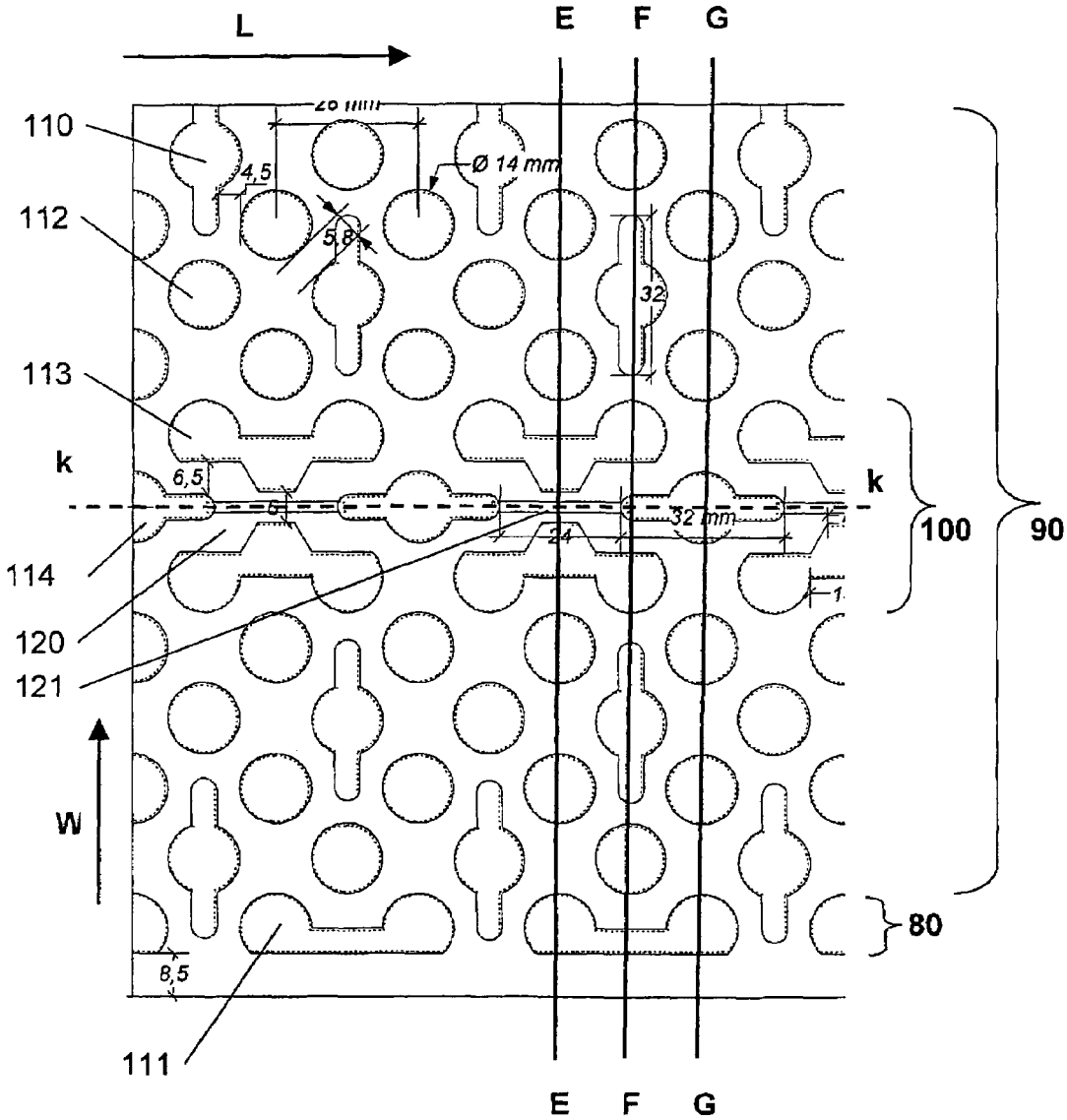
FIG. 8 shows a planar view of a studded plate according to a third embodiment viewed from underneath.

FIG. 8 shows a third embodiment of a plate according to the invention comprising a fold line. In this embodiment the main areas comprise two types of studs, such as circular studs 112 and propeller shaped studs 110, both of which have undercuts, although somewhat offset. The fold line is made up of a central longitudinal row of oblong propeller shaped studs 114, and one row on each side, comprising oblong studs 113. As in the embodiments described earlier, this arrangement also secures a continuous air gap when the plate is folded in 90° along the line k-k which is the centre line of the folding crease. A continuous air gap is secured through the combination of channels 120 generally in the transverse direction and channels 121 generally in the longitudinal direction. The staggering of the studs in the three rows of the fold line will also prevent an optional fabric 2 on the bottom side of the plate in blocking the channels.

Figure 9:
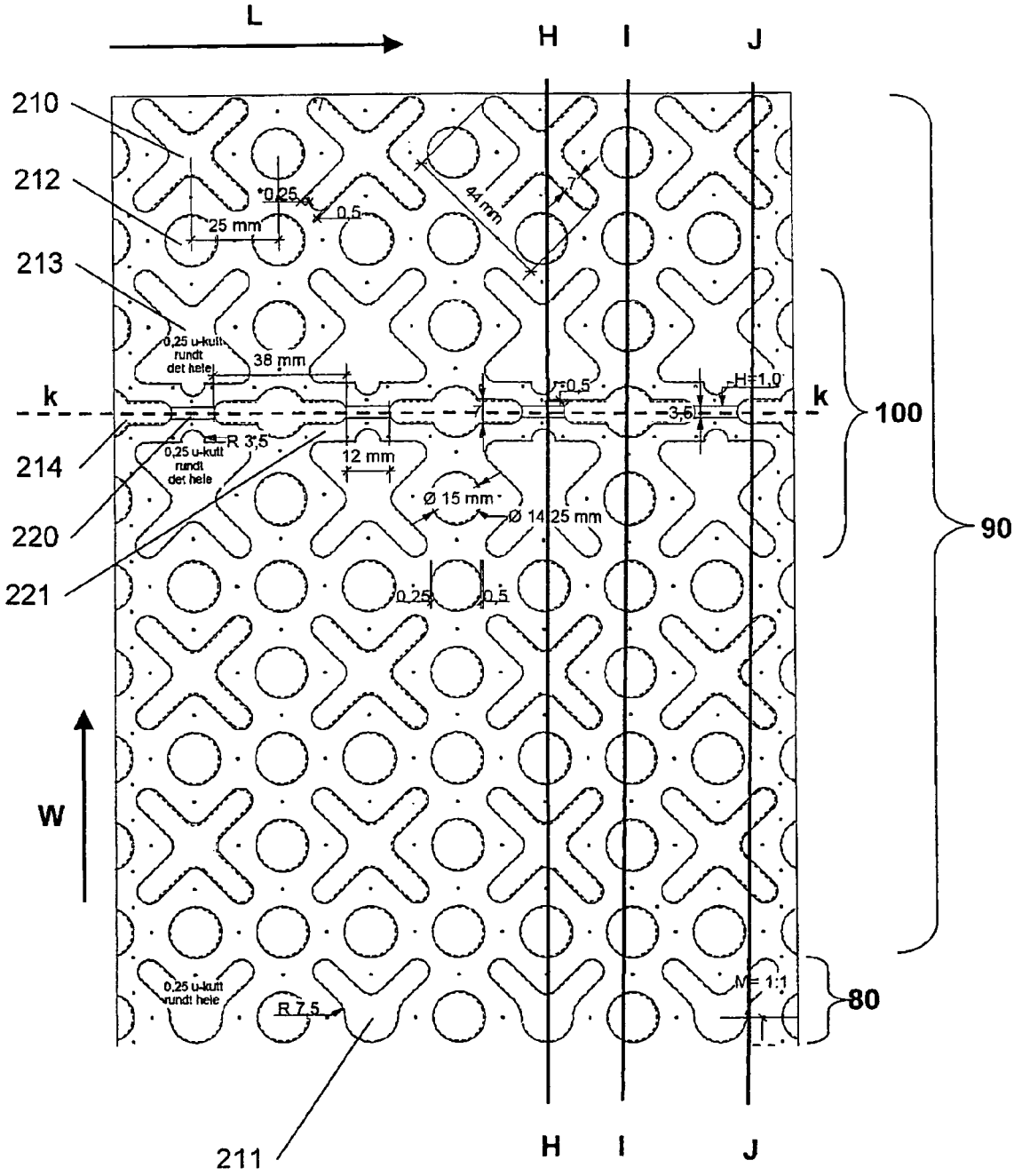
FIG. 9 shows a planar view of a studded plate according to a fourth embodiment viewed from underneath.

Similarly FIG. 9 shows a fourth embodiment of a plate according to the invention comprising a fold line. In this embodiment the main areas comprise two types of studs, such as a cross shaped stud 210 and a circular stud 212, both of which have undercuts, although somewhat offset. The fold line is made up of a central row of oblong propeller studs 214, and two adjacent rows, one on each side, comprising jelly baby-shaped studs 213 that are oblong on the side adjacent to the central row of studs 214. As in the embodiments described earlier, this arrangement also secures a continuous air gap when the plate is folded in 90° along the line k-k, which is the centre line of the fold line. The width of the jelly baby-shaped studs 214, has the advantage of preventing adjacent areas to the fold line in bending when the plate is folded. A continuous air gap is secured through channels 220 and channels 221 generally in the longitudinal and transverse directions respectively. The staggering of the studs in the three rows of the fold line also prevents an optional fabric 2 in blocking the channels.

Figure 10:
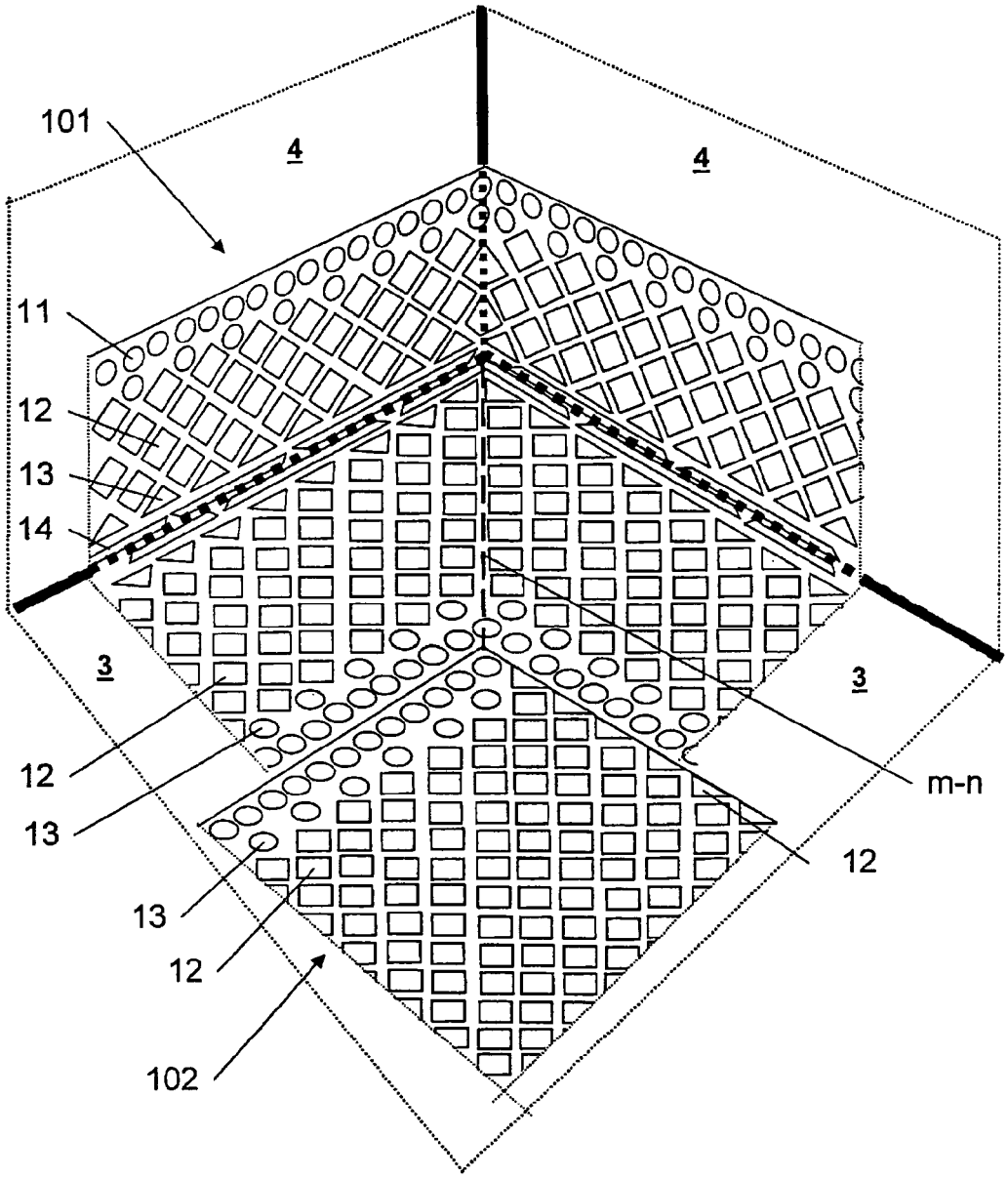
FIG. 10 shows a perspective view of two studded plates arranged in an interior corner against a supporting floor and wall.

FIG. 10 shows a method of placement of a plate according to the invention.

FIG. 10 shows how a first plate 101 is placed against an interior corner by making a cut in the main area, of the part of the plate placed against the floor 3, so that the folded up edge follows the wall 4. In this embodiment the main studs 12 have a diagonal pattern making it simple to adapt the plate to an interior corner in a room by cutting the plate in 45° along two edges, in towards the fold line as indicated in FIG. 2, by cutting lines m and n. The resulting edges will then be laid edge to edge and may be sealed with sealing tape. Another plate may then be placed adjacent to the first plate so that round studs 11 secure a continuous air gap in the joint against the second plate 102.

The result obtained by the use of a plate according to the present invention is a secure and good venting of the floor wherein the plate may be bonded to the floor and/or the wall either temporarily or permanently.

The studded plate is preferably produced in sheets of a plastic or polymer film like material such as for example polypropylene or polyethylene. The fabric or grid material may be comprised of synthetic material such as a polymer material.

The invention claimed is:

1. A studded plate of a polymer material, comprising a first longitudinal edge and a second longitudinal edge, between which edges a main area is arranged in the longitudinal direction of the plate comprising a first type of studs, wherein the main area comprises at least one sub area, in the longitudinal direction of the plate, comprising at least one first row of a second type of studs which have an oblong shape in the longitudinal direction of the plate and at least one adjacent longitudinal row of the second type of studs and a third type of studs comprising a longitudinal adjacent border to the first row of studs, wherein studs in the first row are offset in the longitudinal direction in relation to the studs in the longitudinal adjacent row or rows.

2. Studded plate according to claim 1, wherein the main area comprises a fourth type of stud of any shape in addition to the first type of stud.

3. Studded plate according to claim 1, wherein the distance between the first row and adjacent rows, and the distance between the oblong studs in the longitudinal direction is about the same as the width of the oblong studs.

4. Studded plate according to claim 1, wherein the oblong studs have a rectangular or trapezoidal shape.

5. Studded plate according to claim 1, wherein the first type of studs in the main area have an approximately square shape and optionally are placed in a diagonal pattern in relation to the longitudinal direction.

6. Studded plate according to claim 1, wherein the first and third type of stud in the main area have undercuts.

7. Studded plate according to claim 1 wherein it comprises a longitudinal edge area, adjacent to the first longitudinal edge and the second longitudinal edge of the plate, comprising a type of studs which are smaller in area than the studs in the main area.

8. Studded plate according to claim 7, wherein the studs in said longitudinal edge area have a circular shape and preferably a constant sectional form through the whole depth of the stud.

9. Studded plate according to claim 1, wherein that the plate comprises a grid or a fabric of suitable material fixed to the top of the studs of the plate for ease of attachment of the plate to a substrate by the use of an adhesive.

10. Studded plate according to claim 9, wherein the grid or fabric is of a synthetic material, such as a polymer material.

11. Studded plate according to claim 1, wherein the first type of studs in the main area have a width of from 5 to 50 millimeters, and that the second type of studs in the sub area have a width of from 2 to 25 millimeters and a length of from 10 to 100 millimeters.

12. Studded plate according to claim 1, wherein the main area has a width of from 5 to 300 centimeters, and that the sub area has a width of from 2 to 10 centimeters. p

13. Studded plate according to claim 7, wherein the studs in said longitudinal edge area have a diameter of from about 3 to about 30 millimeters.

14. Studded plate according to claim 7, wherein said longitudinal edge area has a width of from 1 to 30 millimeters.

* * * * *

UNITED STATES PATENT AND TRADEMARK OFFICE

CERTIFICATE OF CORRECTION

PATENT NO. : 7,585,556 B2
APPLICATION NO. : 11/106241
DATED : September 8, 2009
INVENTOR(S) : Julton It is certified that error appears in the above-identified patent and that said Letters Patent is hereby corrected as shown below:

In the Claims:

Column 8, Claim 12, Line 21: After "10 centimeters." please delete "p"

Signed and Sealed this

Twenty-fourth Day of November, 2009

David J. Kappos

David J. Kappos
*Director of the United States Patent and Trademark Office*